US009208749B2

(12) United States Patent
Su et al.

(10) Patent No.: US 9,208,749 B2
(45) Date of Patent: Dec. 8, 2015

(54) ELECTRONIC DEVICE AND METHOD FOR ENHANCING READABILITY OF AN IMAGE THEREOF

(71) Applicant: HTC Corporation, Taoyuan County (TW)

(72) Inventors: Wen-Yueh Su, Taoyuan County (TW); Hsu-Hsiang Tseng, Taoyuan County (TW); Kuo-Feng Chen, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 297 days.

(21) Appl. No.: 13/674,952

(22) Filed: Nov. 13, 2012

(65) Prior Publication Data

US 2014/0132618 A1 May 15, 2014

(51) Int. Cl.
*G09G 5/02* (2006.01)
*G09G 3/20* (2006.01)

(52) U.S. Cl.
CPC .. *G09G 5/02* (2013.01); *G09G 3/20* (2013.01); *G09G 2320/066* (2013.01); *G09G 2320/0626* (2013.01); *G09G 2360/141* (2013.01); *G09G 2360/144* (2013.01)

(58) Field of Classification Search
None
See application file for complete search history.

(56) References Cited

U.S. PATENT DOCUMENTS

| | | | | |
|---|---|---|---|---|
| 6,690,822 | B1 | 2/2004 | Chen et al. | |
| 7,646,931 | B2 | 1/2010 | Liu et al. | |
| 7,742,637 | B2 | 6/2010 | Xiao et al. | |
| 2008/0137986 | A1 * | 6/2008 | Liu et al. | 382/274 |
| 2008/0248837 | A1 | 10/2008 | Kunkel | |
| 2011/0316829 | A1 * | 12/2011 | Oka et al. | 345/207 |
| 2012/0250988 | A1 * | 10/2012 | Peng et al. | 382/165 |
| 2013/0027589 | A1 * | 1/2013 | Johansson | 348/241 |

FOREIGN PATENT DOCUMENTS

| | | | |
|---|---|---|---|
| CN | 1723485 | 1/2006 | |
| EP | 1672614 | 6/2006 | |
| TW | 200613870 | 5/2006 | |
| TW | 200849109 | 12/2008 | |
| TW | 201239810 | 10/2012 | |
| WO | 2012/076906 | 6/2012 | |
| WO | 2012076906 | 6/2012 | |
| WO | WO 2012/076906 A1 * | 6/2012 | G09G 3/34 |

OTHER PUBLICATIONS

"Search Report of European Counterpart Application", issued on Apr. 17, 2014, p. 1-p. 7.
"Office Action of Taiwan Counterpart Application", issued on Apr. 8, 2015, p. 1-p. 5.
"Office Action of China Counterpart Application", issued on Jun. 2, 2015, p. 1-p. 15.

* cited by examiner

*Primary Examiner* — Mark Zimmerman
*Assistant Examiner* — Vu Nguyen
(74) *Attorney, Agent, or Firm* — Jianq Chyun IP Office

(57) ABSTRACT

An electronic device is provided, which includes a light sensor, an algorithm engine, an adjustment engine, and a display. The light sensor detects an ambient brightness around the electronic device. The algorithm engine is coupled to the light sensor. The algorithm engine determines at least one adjustment function according to the ambient brightness. The adjustment engine is coupled to the algorithm engine. The adjustment engine adjusts the luminance component of each pixel of an image according to the at least one adjustment function to enhance the brightness and/or the contrast of the image. The display is coupled to the adjustment engine for displaying the adjusted image.

20 Claims, 5 Drawing Sheets

300

ELECTRONIC DEVICE AND METHOD FOR ENHANCING READABILITY OF AN IMAGE THEREOF

BACKGROUND OF THE DISCLOSURE

1. Field of the Disclosure

The present disclosure relates to an image displayed by an electronic device. More particularly, the present disclosure relates to an electronic device and a method for enhancing the readability of an image displayed by the electronic device.

2. Description of the Related Art

Display is the key component of a mobile electronic device, such as a smart phone or a tablet computer. Improving the image quality is one of the main trends to drive the progress of the display industry.

Due to the limitation of the brightness of the display, it is very difficult to see an image displayed in an outdoor environment, especially under the sunlight, which often bleaches the details of the image and limits the usage of mobile electronic devices.

SUMMARY OF THE DISCLOSURE

Accordingly, the present disclosure is directed to an electronic device and a method for enhancing the readability of an image displayed by the electronic device in a bright environment.

According to an embodiment of the present disclosure, an electronic device is provided. The electronic device includes a light sensor, an algorithm engine, an adjustment engine, and a display. The light sensor detects an ambient brightness around the electronic device. The algorithm engine is coupled to the light sensor. The algorithm engine determines at least one adjustment function according to the ambient brightness. The adjustment engine is coupled to the algorithm engine. The adjustment engine adjusts the luminance component of each pixel of an image according to the at least one adjustment function to enhance the brightness and/or the contrast of the image. The display is coupled to the adjustment engine for displaying the adjusted image.

According to another embodiment of the present disclosure, a method for enhancing the readability of an image is provided. The method detects an ambient brightness around an electronic device by the light sensor of the electronic device. The method determines at least one adjustment function according to the ambient brightness. The method adjusts the luminance component of each pixel of the image according to the at least one adjustment function to enhance the brightness and/or the contrast of the image. The method displays the adjusted image on the electronic device.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
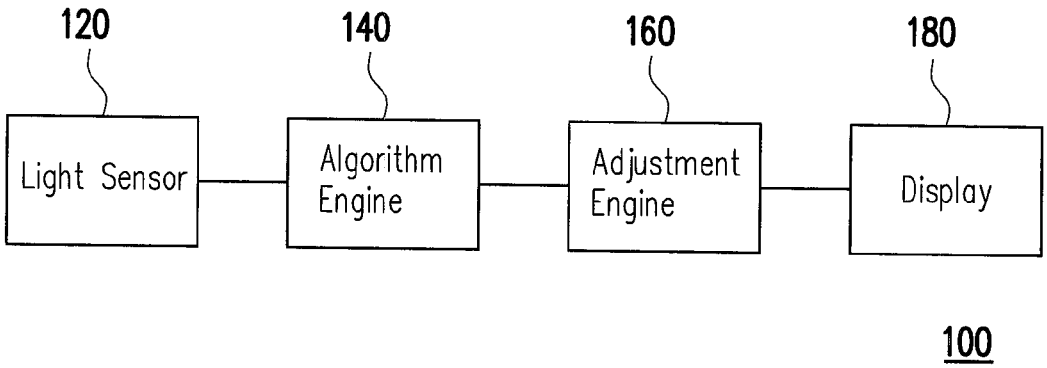
FIG. 1 is a schematic diagram showing an electronic device according to an embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

Figure 2:
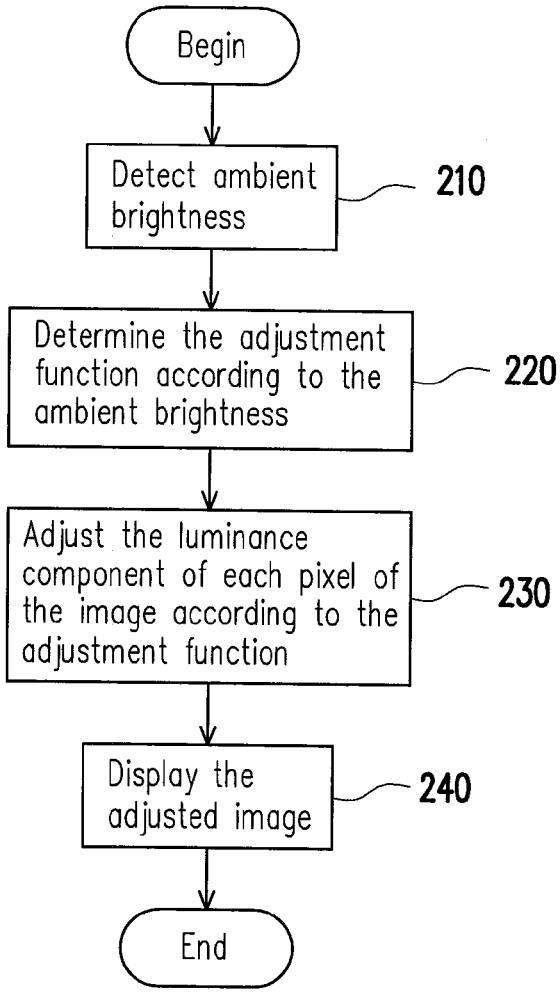
FIG. 2 is a flow chart showing a method for enhancing the readability of an image according to an embodiment of the present disclosure.

FIG. 1 is a schematic diagram showing an electronic device 100 according to an embodiment of the present disclosure. The electronic device 100 includes a light sensor 120, an algorithm engine 140, an adjustment engine 160, and a display 180. The algorithm engine 140 is coupled to the light sensor 120. The adjustment engine 160 is coupled to the algorithm engine 140. The display 180 is coupled to the adjustment engine 160. FIG. 2 is a flow chart showing a method for enhancing the readability of an image according to an embodiment of the present disclosure. The method shown in FIG. 2 may be executed by the electronic device 100.

At step 210, the light sensor 120 detects the ambient brightness around the electronic device 100. At step 220, the algorithm engine 140 determines at least one adjustment function according to the ambient brightness. At step 230, the adjustment engine 160 adjusts the luminance component of each pixel of an image according to the at least one adjustment function to enhance the brightness and/or the contrast of the image. The image may be a static picture, a frame of a dynamic video, or a graphical user interface (GUI) of the electronic device 100. The adjustment engine 160 may simply input the luminance component of each pixel of the image into the adjustment function and replaces the original luminance component of each pixel with the output of the adjustment function. At step 240, the display 180 displays the image adjusted by the adjustment engine 160.

The algorithm engine 140 knows the brightness level of the ambient environment based on the output of the light sensor 120. The light sensor 120 may be used as the trigger for the adjustment of the image. For example, when the ambient brightness is lower than a preset level, the algorithm engine 140 may output an idle adjustment function (a function whose output is equal to its input) to the adjustment engine 160, which means no adjustment. In other words, for any pixel A of the image, $L_A'$ is equal to $L_A$. $L_A$ is the luminance component of the pixel A before the adjustment and $L_A'$ is the luminance component of the pixel A after the adjustment.

When the ambient brightness is equal to or higher than the preset level, the algorithm engine 140 may output at least one non-idle adjustment function to the adjustment engine 160 to enhance the brightness and/or the contrast of the image. The algorithm engine 140 may determine only one adjustment function for the adjustment engine 160 to adjust each of the pixels of the image according to the same adjustment function. Alternatively, the algorithm engine 140 may determine a plurality of adjustment functions for the adjustment engine 160 to adjust each of the pixels of the image according to one of the adjustment functions.

The adjustment engine 160 adjusts only the luminance component of each pixel. When the image is represented in a color space having a luminance component such as the YCbCr color space, the adjustment engine 160 may adjust each pixel of the image directly. When the image is represented in a color space that does not have any luminance component such as the RGB color space, the adjustment engine 160 may convert each pixel from the original color space to a color space that has a luminance component, adjusts the luminance component of each pixel according to the at least one adjustment function determined by the algorithm engine 140, and converts each pixel back to the original color space.

The algorithm engine 140 may provide each of the at least one adjustment function in a form of a lookup table to the adjustment engine 160 such that each of the at least one adjustment function is used in a form of a lookup table.

Figure 3:
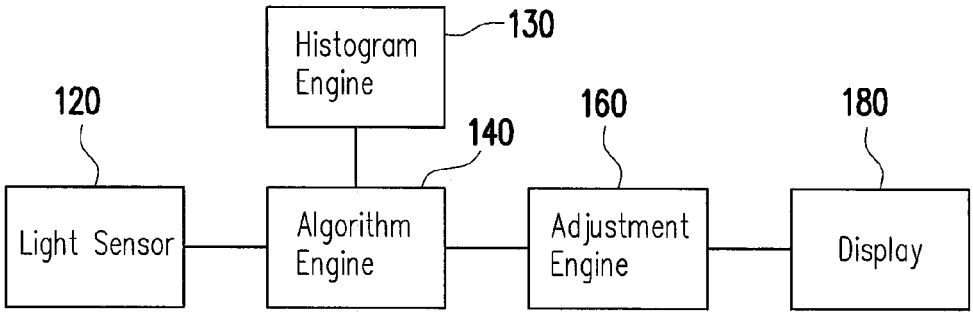
FIG. 3 is a schematic diagram showing an electronic device according to another embodiment of the present disclosure.
Figure 4:
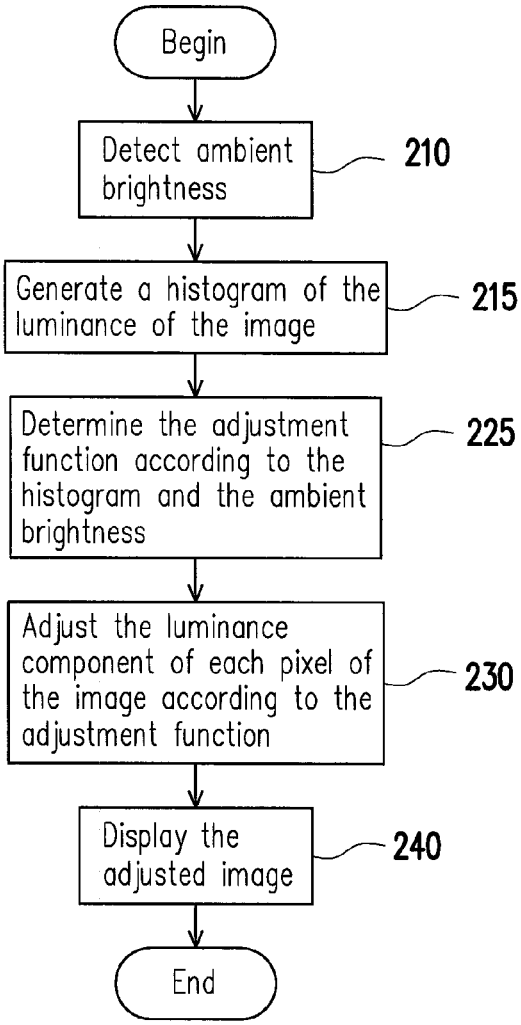
FIG. 4 is a flow chart showing a method for enhancing the readability of an image according to another embodiment of the present disclosure.

FIG. 3 is a schematic diagram showing an electronic device 300 according to an embodiment of the present disclosure. The electronic device 300 includes a light sensor 120, a histogram engine 130, an algorithm engine 140, an adjustment engine 160, and a display 180. The adjustment engine 160 is coupled to the display 180. The algorithm engine 140 is coupled to the light sensor 120, the histogram engine 130, and the adjustment engine 160. The light sensor 120, the adjustment engine 160, and the display 180 are the same as their counterparts in the electronic device 100. FIG. 4 is a flow chart showing a method for enhancing the readability of an image according to an embodiment of the present disclosure. The method shown in FIG. 4 may be executed by the electronic device 300. Steps 210, 230 and 240 in FIG. 4 are the same as their counterparts in FIG. 2. At step 215, the histogram engine 130 generates a histogram of the luminance components of the pixels of the image. At step 225, the algorithm engine 140 determines the at least one adjustment function according to the histogram generated by the histogram engine 130 and the ambient brightness detected by the light sensor 120.

The algorithm engine 140 may determine a different adjustment function for each of a plurality of types and classifies the image under one of the types according to the histogram. The adjustment engine 160 may adjust all of the pixels of the image according to the same adjustment function corresponding to the type of the image.

Figure 5:
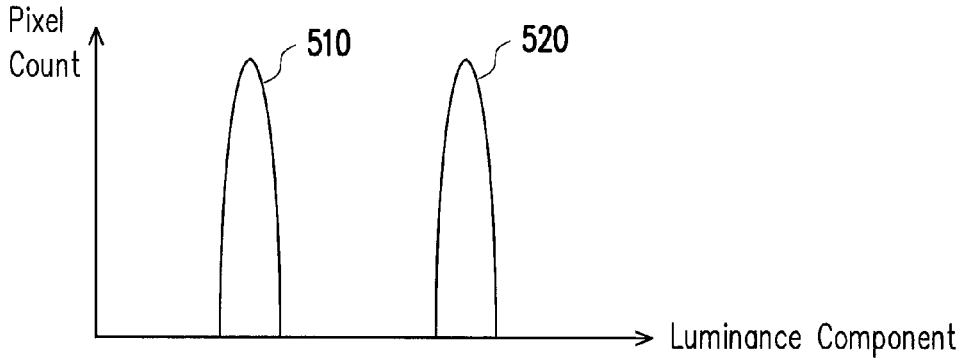
FIG. 5 is a histogram of an image according to an embodiment of the present disclosure.

For example, there may be two types of images, namely, black-and-white text and color picture. FIG. 5 is a histogram of an image of the black-and-white text type according to an embodiment of the present disclosure. The horizontal axis of the histogram represents the values of the luminance components of the pixels of the image, while the vertical axis of the histogram represents the pixel count of each luminance value of the pixels. The histogram of the image in FIG. 5 includes two parts 510 and 520. The part 510 is the histogram of the black text and the part 520 is the histogram of the white background.

Figure 6:
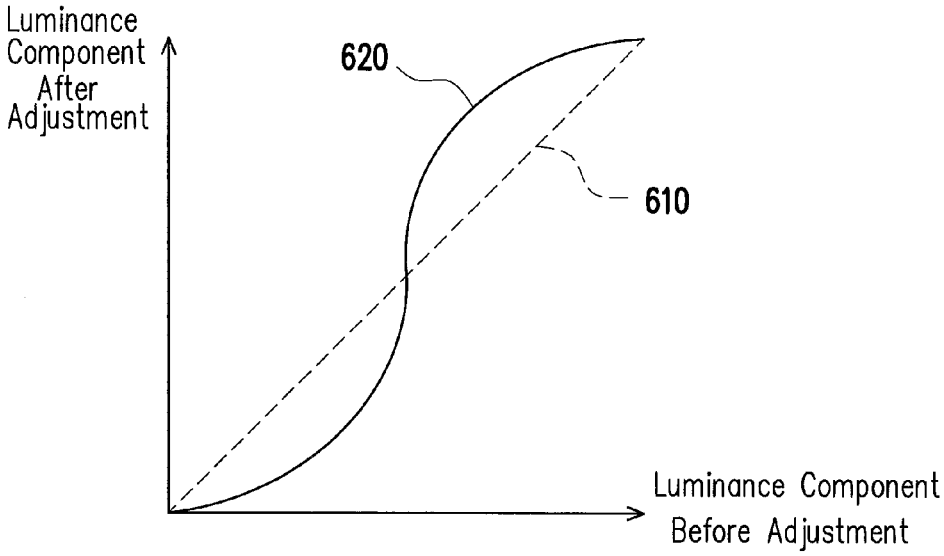
FIG. 6 is a schematic diagram showing the curve of an adjustment function according to an embodiment of the present disclosure.

FIG. 6 is a schematic diagram showing the curve of an adjustment function used in this example. Curve 610 is the aforementioned idle adjustment function, whose output is equal to its input. Curve 620 is the adjustment function determined by the algorithm engine 140 and used by the adjustment engine 160 in this example. The horizontal axis in FIG. 6 represents the original values of the luminance components of the pixels of the image before the adjustment of the adjustment engine 160, while the vertical axis in FIG. 6 represents the values of the luminance components of the pixels of the image after the adjustment of the adjustment engine 160.

Figure 7:
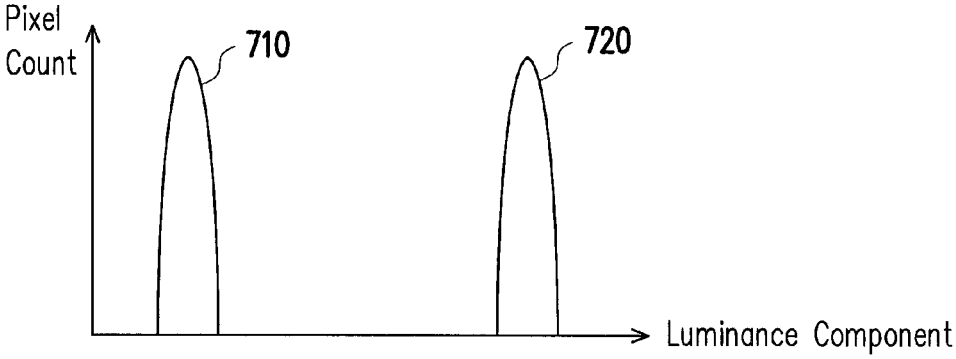
FIG. 7 is a histogram of an image according to an embodiment of the present disclosure.

As can be seen in FIG. 6, the adjustment function 620 corresponding to the black-and-white text type suppresses the luminance components of the darker pixels and enhances the luminance components of the brighter pixels. In other words, the adjustment function 620 increases the contrast of the image. The histogram of the image after the adjustment of the adjustment engine 160 is shown in FIG. 7. The gap between the two parts 710 and 720 is wider than that between the two parts 510 and 520, which means the adjustment improves the contrast of the image. Therefore, the image has better readability in a bright environment.

Figure 8:
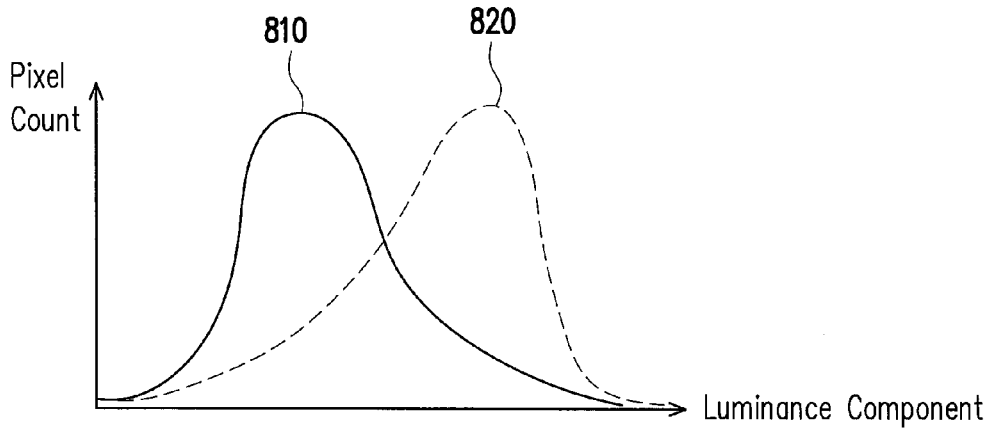
FIG. 8 shows a histogram of an image before adjustment and a histogram of the image after adjustment according to an embodiment of the present disclosure.
Figure 9:
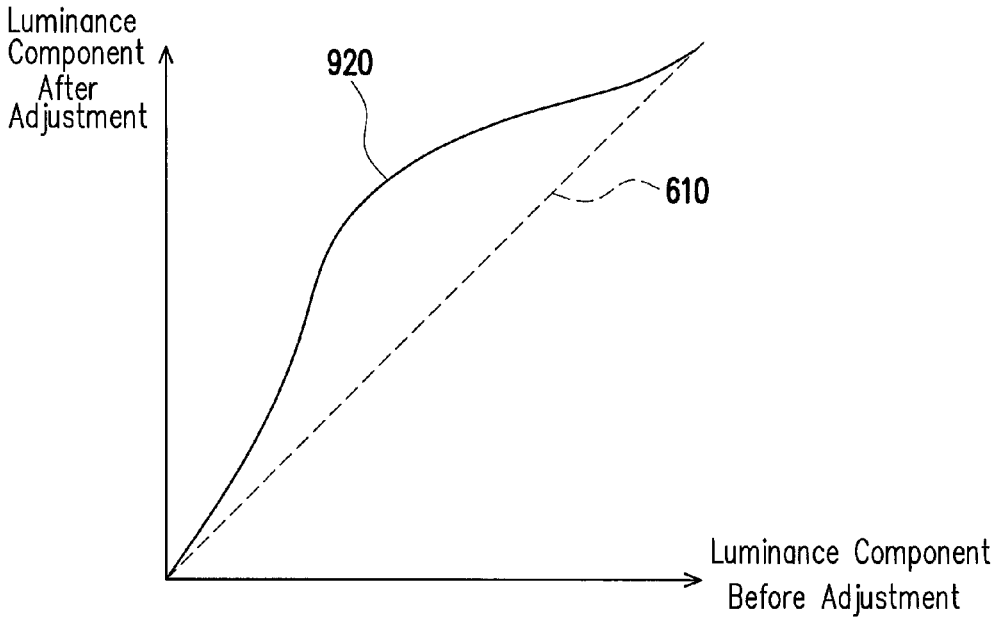
FIG. 9 is a schematic diagram showing the curve of an adjustment function according to an embodiment of the present disclosure.

Take another example. FIG. 8 shows a histogram 810 of an image of the color picture type before the adjustment and a histogram 820 of the same image after the adjustment according to an embodiment of the present disclosure. FIG. 9 is a schematic diagram showing the curve 920 of the adjustment function determined by the algorithm engine 140 and used by the adjustment engine 160 in this example. In contrast to the idle adjustment function 610, the adjustment function 920 corresponding to the color picture type enhances the luminance components of the pixels of the image. Therefore, the image has better readability in a bright environment.

In an embodiment of the present disclosure, the algorithm engine 140 may divide the pixels of the image into a plurality of sets according to the histogram of the image and determines a different adjustment function for each of the sets. The adjustment engine 160 may adjust all of the pixels of each set according to the same adjustment function corresponding to the set.

Figure 10:
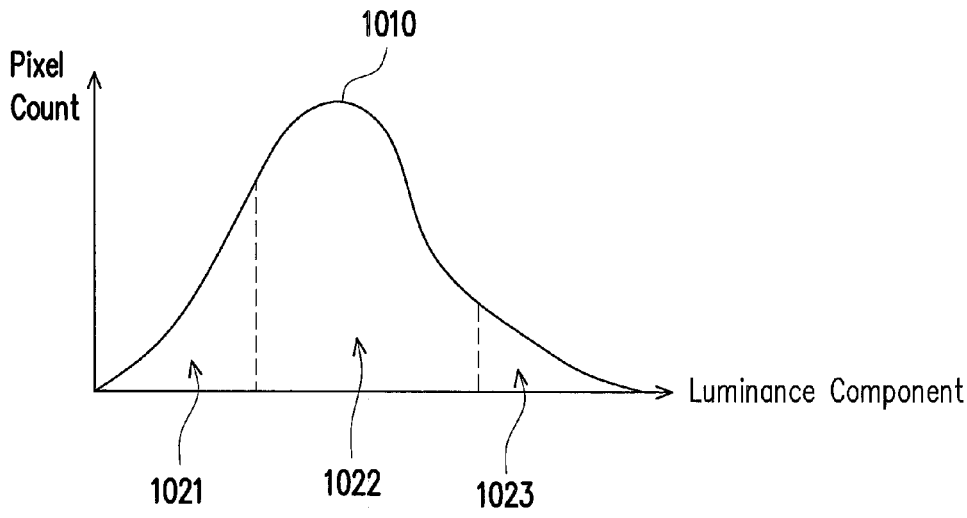
FIG. 10 is a histogram of an image according to an embodiment of the present disclosure.

For example, FIG. 10 shows a histogram 1010 of an image according to an embodiment of the present disclosure. The algorithm engine 140 may divide the pixels of the image into three sets 1021-1023. The set 1021 includes the darkest pixels, the set 1023 includes the brightest pixels, and the set 1022 includes the intermediate pixels. The algorithm engine 140 may determine three different adjustment functions. Each adjustment function is to be used by the adjustment engine 160 for one of the three sets 1021-1023. The adjustment function corresponding to the darker pixels may provide more adjustment than the adjustment function corresponding to the brighter pixels does. In this way, the adjustment engine 160 can improve the readability of the image in a bright environment by lightening up the dark areas of the image.

In an embodiment of the present disclosure, the algorithm engine 140 may provide one or more adjustment functions such that the darker pixels of an image receives more adjustment than the brighter pixels of the image do. In other words, for any two pixels A and B of the image, when $L_A$ is smaller than $L_B$, $|L_A'-L_A|$ is equal to or larger than $|L_B'-L_B|$. $\|$ is an absolute value operator, $L_A$ is the luminance component of the pixel A before the adjustment, $L_A'$ is the luminance component of the pixel A after the adjustment, $L_B$ is the luminance component of the pixel B before the adjustment, and $L_B'$ is the luminance component of the pixel B after the adjustment.

In an embodiment of the present disclosure, the algorithm engine 140 may provide one or more adjustment functions according to the ambient brightness detected by the light sensor 120 such that for any pixel A of the image, $|L_A'-L_A|$ is directly proportional to the level of the ambient brightness. || is an absolute value operator, $L_A$ is the luminance component of the pixel A before the adjustment and $L_A'$ is the luminance component of the pixel A after the adjustment. In other words, as the environment gets brighter, the pixels of the image receive more adjustment.

Figure 11:
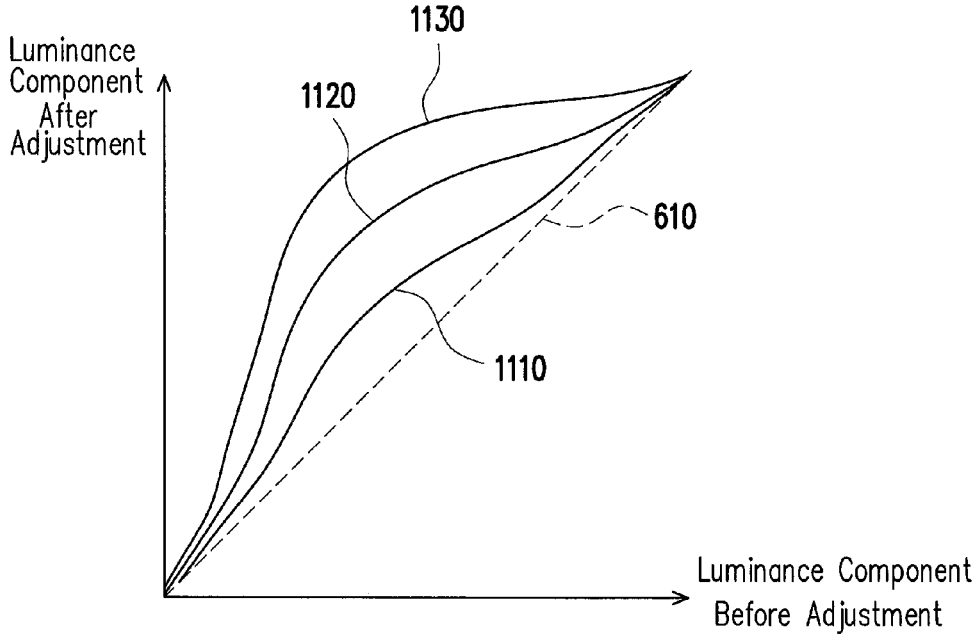
FIG. 11 is a schematic diagram showing the curves of some adjustment functions for an image according to an embodiment of the present disclosure.

For example, FIG. 11 is a schematic diagram showing the curves 1110, 1120 and 1130 of some adjustment functions determined by the algorithm engine 140 for an image according to an embodiment of the present disclosure. When the ambient brightness is at a preset level $L_1$, the adjustment engine 160 may use the adjustment function 1110 to adjust the luminance components of the pixels of the image. When the ambient brightness increases to another preset level $L_2$ that is higher than $L_1$, the adjustment engine 160 may use the adjustment function 1120 to adjust the luminance components of the pixels of the image. When the ambient brightness increases to another preset level $L_3$ that is higher than $L_2$, the adjustment engine 160 may use the adjustment function 1130 to adjust the luminance components of the pixels of the image.

The previous embodiments provide simple examples of the present disclosure. The present disclosure is not limited to the previous embodiments. Since there are already many techniques for enhancing the brightness and/or the contrast of an image in the field of image processing, the algorithm engine 140 may provide the at least one adjustment function to the adjustment engine 160 based on any existent technique or any combination of existent techniques in the field of image processing.

In summary, the present disclosure combines light sensor and image enhancement to improve the readability of images displayed by an electronic device in a bright environment, such as an outdoor environment.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. An electronic device, comprising:

a light sensor, detecting an ambient brightness around the electronic device;

an algorithm engine, coupled to the light sensor, determining at least one adjustment function according to the ambient brightness;

a histogram engine, coupled to the algorithm engine, generating a histogram of the luminance components of a plurality of pixels of an image, wherein the algorithm engine determines the at least one adjustment function according to the histogram and the ambient brightness, wherein the algorithm engine divides the pixels of the image into a plurality of sets according to the histogram and determines a different adjustment function for each of the sets;

an adjustment engine, coupled to the algorithm engine, adjusting a luminance component of each pixel of the image according to the at least one adjustment function to enhance brightness and/or contrast of the image, wherein the adjustment engine adjusts all of the pixels of each of the sets according to the same adjustment function corresponding to the set; and a display, coupled to the adjustment engine, displaying the adjusted image.

2. The electronic device of claim 1, wherein the adjustment engine adjusts each of the pixels of the image according to the same adjustment function.

3. The electronic device of claim 1, wherein the algorithm engine determines a plurality of adjustment functions and the adjustment engine adjusts each of the pixels of the image according to one of the adjustment functions.

4. The electronic device of claim 1, wherein for any two pixels A and B of the image, when $L_A$ is smaller than $L_B$, $|L_A'-L_A|$ is equal to or larger than $|L_B'-L_B|$, wherein || is an absolute value operator, $L_A$ is the luminance component of the pixel A before the adjustment, $L_A'$ is the luminance component of the pixel A after the adjustment, $L_B$ is the luminance component of the pixel B before the adjustment, $L_B'$ is the luminance component of the pixel B after the adjustment.

5. The electronic device of claim 1, wherein for any pixel A of the image, $L_A'$ is equal to $L_A$ when the ambient brightness is lower than a preset level, wherein $L_A$ is the luminance component of the pixel A before the adjustment and $L_A'$ is the luminance component of the pixel A after the adjustment.

6. The electronic device of claim 1, wherein for any pixel A of the image, $|L_A-L_A|$ is directly proportional to a level of the ambient brightness, wherein || is an absolute value operator, $L_A$ is the luminance component of the pixel A before the adjustment and $L_A'$ is the luminance component of the pixel A after the adjustment.

7. The electronic device of claim 1, wherein the algorithm engine determines a different adjustment function for each of a plurality of types and classifies the image under one of the types according to the histogram, the adjustment engine adjusts all of the pixels of the image according to the same adjustment function corresponding to the type of the image.

8. The electronic device of claim 1, wherein for each of the pixels of the image, the adjustment engine converts the pixel from a first color space to a second color space, adjusts the luminance component of the pixel according to the at least one adjustment function, and converts the pixel back to the first color space, wherein the first color space does not have any luminance component and the second color space has a luminance component.

9. The electronic device of claim 1, wherein the algorithm engine provides each of the at least one adjustment function in a form of a lookup table to the adjustment engine.

10. The electronic device of claim 1, wherein the image is a static picture, a frame of a dynamic video, or a graphical user interface (GUI) of the electronic device.

11. A method for enhancing readability of an image, comprising:

detecting an ambient brightness around an electronic device by the light sensor of the electronic device;

determining at least one adjustment function according to the ambient brightness, wherein the electronic device generates a histogram of the luminance components of a plurality of pixels of the image and determines the at least one adjustment function according to the histogram and the ambient brightness, wherein the pixels of the image are divided into a plurality of sets according to the histogram, and a different adjustment function is determined for each of the sets;

adjusting a luminance component of each pixel of the image according to the at least one adjustment function to enhance brightness and/or contrast of the image, wherein all of the pixels of each of the sets are adjusted according to the same adjustment; and displaying the adjusted image on the electronic device.

12. The method of claim 11, wherein the step of adjusting the luminance component of each of the pixels of the image comprises:

adjusting each of the pixels of the image according to the same adjustment function.

13. The method of claim 11, wherein the step of adjusting the luminance component of each of the pixels of the image comprises:

determining a plurality of adjustment functions; and adjusting each of the pixels of the image according to one of the adjustment functions.

14. The method of claim 11, wherein for any two pixels A and B of the image, when $L_A$ is smaller than $L_B$, $|L_A'-L_A|$ is equal to or larger than $|L_B'-L_B|$, wherein || is an absolute value operator, $L_A$ is the luminance component of the pixel A before the adjustment, $L_A'$ is the luminance component of the pixel A after the adjustment, $L_B$ is the luminance component of the pixel B before the adjustment, $L_B'$ is the luminance component of the pixel B after the adjustment.

15. The method of claim 11, wherein for any pixel A of the image, $L_A'$ is equal to $L_A$ when the ambient brightness is lower than a preset level, wherein $L_A$ is the luminance component of the pixel A before the adjustment and $L_A'$ is the luminance component of the pixel A after the adjustment.

16. The method of claim 11, wherein for any pixel A of the image, $|L_A'-L_A|$ is directly proportional to a level of the ambient brightness, wherein || is an absolute value operator, $L_A$ is the luminance component of the pixel A before the adjustment and $L_A'$ is the luminance component of the pixel A after the adjustment.

17. The method of claim 11, further comprising:

determining a different adjustment function for each of a plurality of types;

classifying the image under one of the types according to the histogram; and adjusting all of the pixels of the image according to the same adjustment function corresponding to the type of the image.

18. The method of claim 11, wherein for each of the pixels of the image, the step of adjusting the luminance component of each of the pixels of the image comprises:

converting the pixel from a first color space to a second color space;

adjusting the luminance component of the pixel according to the at least one adjustment function; and converting the pixel back to the first color space, wherein the first color space does not have any luminance component and the second color space has a luminance component.

19. The method of claim 11, wherein each of the at least one adjustment function is used in a form of a lookup table.

20. The method of claim 11, wherein the image is a static picture, a frame of a dynamic video, or a graphical user interface (GUI) of the electronic device.

* * * * *